US011596031B2

(12) United States Patent
Anson

(10) Patent No.: US 11,596,031 B2
(45) Date of Patent: Feb. 28, 2023

(54) SYSTEM AND METHOD OF HEATING A TOOL WITH ELECTROMAGNETIC RADIATION

(71) Applicant: Jonathan Ross Anson, Simi Valley, CA (US)

(72) Inventor: Jonathan Ross Anson, Simi Valley, CA (US)

( * ) Notice: Subject to any disclaimer, the term of this patent is extended or adjusted under 35 U.S.C. 154(b) by 494 days.

(21) Appl. No.: 16/835,245

(22) Filed: Mar. 30, 2020

(65) Prior Publication Data

US 2020/0314971 A1 Oct. 1, 2020

Related U.S. Application Data

(60) Provisional application No. 62/826,650, filed on Mar. 29, 2019.

(51) Int. Cl.

| | |
|---|---|
| ***H05B 6/62*** | (2006.01) |
| ***H05B 6/50*** | (2006.01) |
| ***H05B 1/02*** | (2006.01) |

(52) U.S. Cl.
CPC ..... *H05B 6/62* (2013.01); *H05B 6/50* (2013.01); *H05B 1/0252* (2013.01)

(58) Field of Classification Search
CPC ..... H05B 1/0252; H05B 6/106; H05B 6/50; H05B 6/62; H05B 6/365
USPC ..... 219/678–680
See application file for complete search history.

(56) References Cited

U.S. PATENT DOCUMENTS

| | | | | |
|---|---|---|---|---|
| 10,595,661 | B2 * | 3/2020 | Fryshman | A47J 27/002 |
| 2011/0117202 | A1 * | 5/2011 | Bourke, Jr. | H01J 65/042 977/773 |
| 2019/0321099 | A1 * | 10/2019 | Almutairi | A61N 5/062 |

* cited by examiner

*Primary Examiner* — Dana Ross
*Assistant Examiner* — Joe E Mills, Jr.

(57) ABSTRACT

A system and method of heating a tool with electromagnetic radiation aims to harness the dialectic heating effect of radio waves on metallic nanoparticles to generate controllable, user-safe, highly variable heat with the use of a specific supporting structure. It is considered that the method may be applied to a variety of existing assemblies, such as a knife, a cooking pot, a jacket, and other embodiments. The system of the present invention provides at least one tool body, at least one suspension mechanism, and a plurality of photothermal particles. Furthermore, at least one portable electromagnetic (EM) wave generator is provided, wherein the portable EM wave generator either is integrated into the tool body, or is positioned adjacent to the tool body, wherein the portable EM wave generator includes a manual on/off switch. The overall process allows for controlled generation of heat within a variety of physical objects.

12 Claims, 12 Drawing Sheets

SYSTEM AND METHOD OF HEATING A TOOL WITH ELECTROMAGNETIC RADIATION

The current application claims a priority to the U.S. Provisional Patent application Ser. No. 62/826,650 filed on Mar. 29, 2019. The current application is filed on Mar. 30, 2020 while Mar. 29, 2020 was on a weekend.

FIELD OF THE INVENTION

The present invention relates generally to a method of employing the heat generated via the exposure of a resonant metallic suspension to radiofrequency irradiation. More specifically, the present invention contemplates utilizing this phenomenon to remotely generate heat within specifically constructed bodies outwardly similar to various existing devices.

BACKGROUND OF THE INVENTION

Outdoor recreational activities, such as hiking, backpacking, bicycle touring, mountain climbing, trekking, and more, have experienced a resurgence in popularity, perhaps in response to the increasingly prevalent sedentary lifestyle. Participants in these activities often experience extended periods of isolation from otherwise common luxuries; notably, climate control tools such as heating are scarcely found in the wild. Therefore, participants and enthusiasts are known to require reliable, portable, safe sources of on-demand heat. A source of heat provides comfort, protection from sickness, a means of purifying water and foodstuffs, and in many cases is the single most important factor in determining not only the comfort of an extended trip exposed to the elements, but also the odds of survival in extreme environments.

The most common solution to a lack of adequate warmth or heat is the creation and maintenance of a fire. Fire has been the go-to source of heat and light since before antiquity; a universally useful asset to anyone hoping to brave the harsher conditions of the wilderness. However, fire may not be desirable in certain environments for fear of losing control, may be impossible to start due to excessive dampness, or may otherwise be unattainable due to a lack of suitable fuel. In any of these scenarios, individuals may turn to chemical heater packs, gas-powered stoves, or electrical resistive coils. However, these all have notable drawbacks for an individual on the move. Chem-heaters are only active for a short time before completing their exothermic reaction and losing their potency. Gas-powered stoves require bulky, heavy canisters to function (in addition to the base devices). Resistive coils are likewise difficult to use in a variety of situations; coils suitable for cooking are too hot for heating a body, and coils for a body are too cool for cooking. What is needed is a universal, effective, safe, portable source of heat.

In an adjacent field, experimental methods for treating cancer involving injecting a solution containing gold or carbon nanoparticles into a tumor, then exposing said solution (within the tumor) to radio waves has been developed. Given the low absorption rate of living tissues for radio-frequency energy, the waves may "target" the metals for dielectric heating. This process has been observed to elicit an exothermic response from the solution; as the nanoparticles absorb the radio-frequency energy they convert said energy not local thermal energy, heating the solution and any surrounding materials. It is hoped that this effect may be used to point-target malignant tissue for non-invasive radio-frequency radiation therapy. Further desirable from a technology development standpoint is employment of this radiative heating to alternative applications.

The present invention aims to harness the dialectic heating effect of radio waves on metallic nanoparticles to generate controllable, user-safe, highly variable heat with the use of a specific supporting structure. It is considered that the present invention may be applied to a variety of existing assemblies, such as a knife, a cooking pot, a jacket, and other embodiments that may be realized by an individual skilled in the art of tool or clothing manufacture. It is further contemplated that a broadcast source for localized radio-frequency energy may be miniaturized and made portable, such that the supporting structure described herein may be directly exposed to the energies required for effective use of the present invention. Further, the power supply for the radio-frequency source is contemplated to comprise a varied and composite assembly of available and known means of providing electrical energy to said source, including batteries, grid connections, and personal generators among other means.

DETAILED DESCRIPTION OF THE INVENTION

All illustrations of the drawings are for the purpose of describing selected versions of the present invention and are not intended to limit the scope of the present invention.

Figure 1:
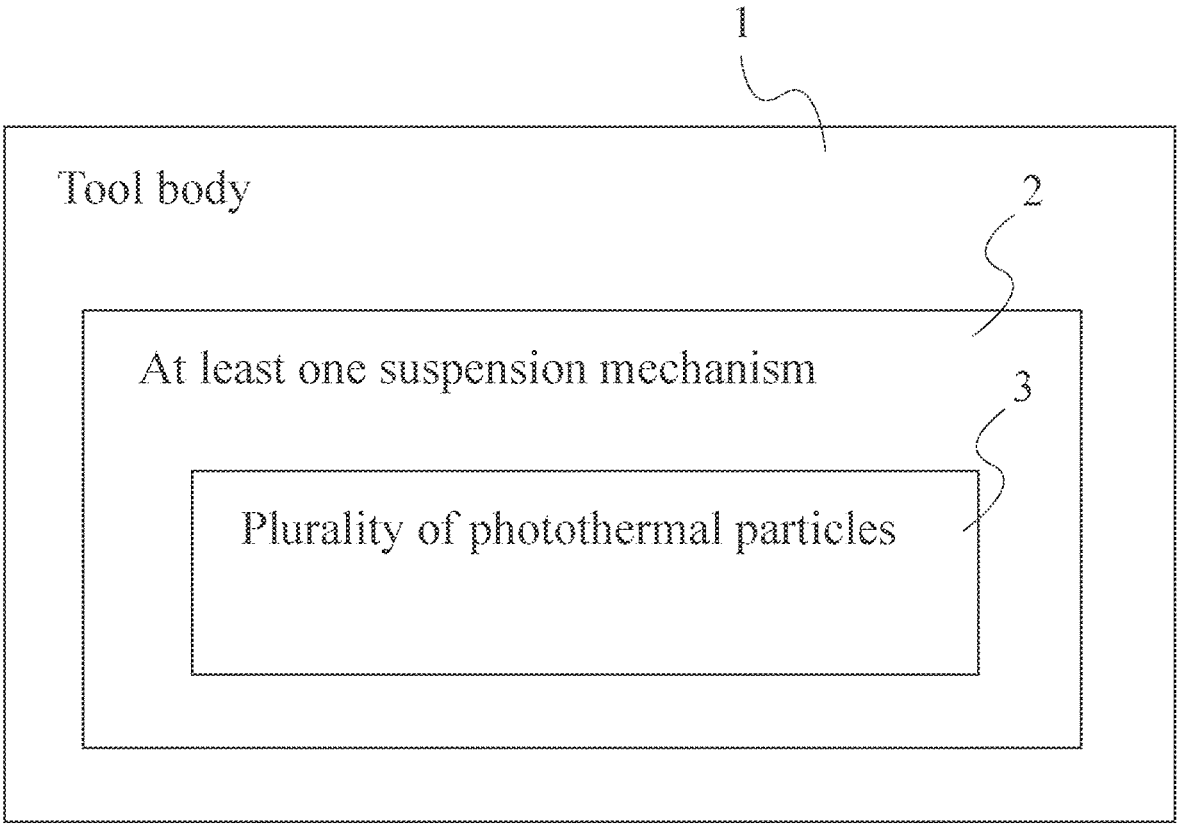
FIG. 1 is a block diagram illustrating the arrangement of the plurality of photothermal particles.
Figure 2:
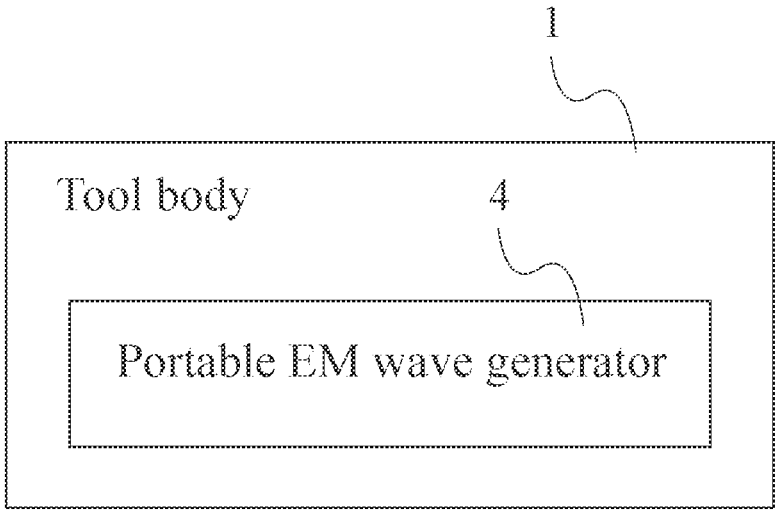
FIG. 2 is a block diagram illustrating an arrangement of the portable electromagnetic (EM) wave generator.
Figure 3:
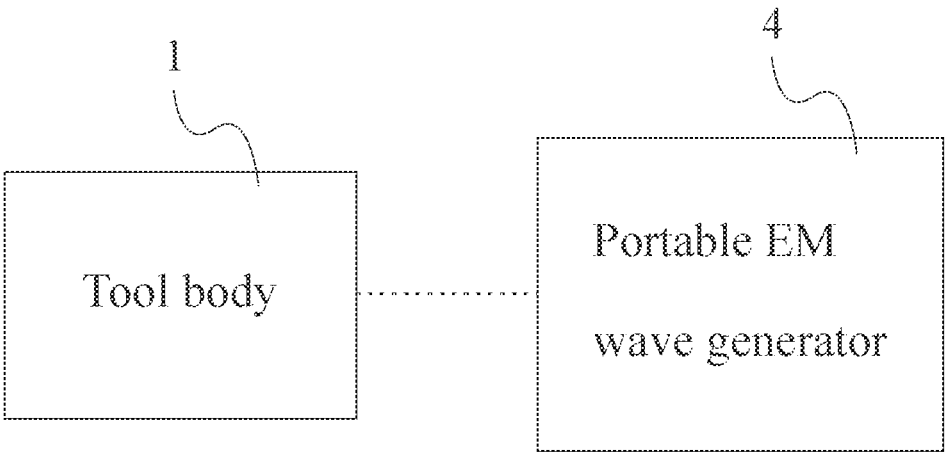
FIG. 3 is a block diagram illustrating another arrangement of the portable EM wave generator.
Figure 4:
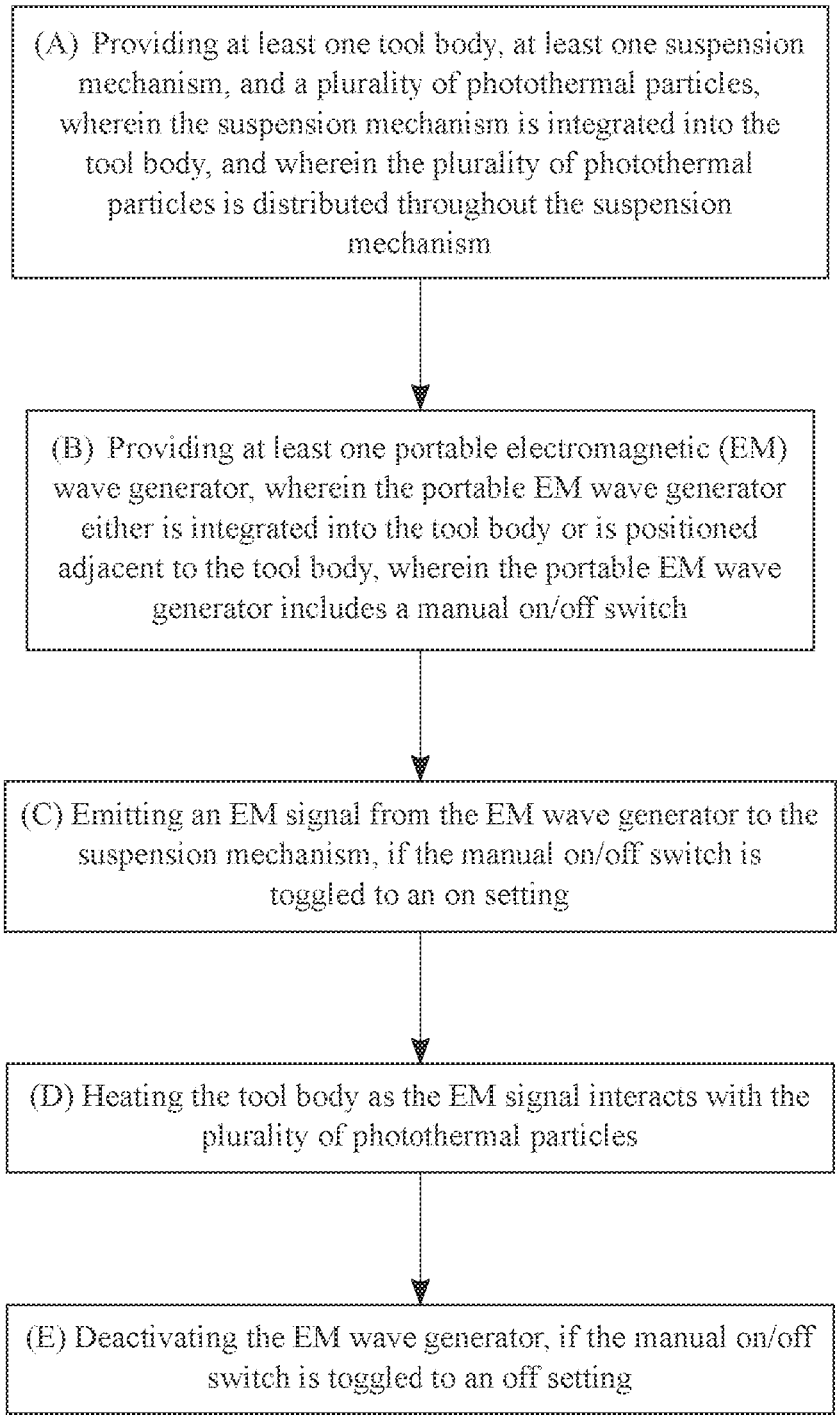
FIG. 4 is a flowchart illustrating an overall process for the method of the present invention.

The present invention is a method of heating a tool with electromagnetic radiation that provides a system for harnessing the heat generated from various particles that are exposed to appropriate controlled radiative energy. More specifically, the present invention provides a preferred procedure for employing these particles in order to heat a variety of different items. The system of the present invention provides at least one tool body 1, at least one suspension mechanism 2, and a plurality of photothermal particles 3, wherein the suspension mechanism 2 is integrated into the tool body 1, and wherein the plurality of photothermal particles 3 is distributed throughout the suspension mechanism 2 (Step A), as represented in FIGS. 1 and 4. The tool body 1 relates to the volume occupied by an object to which a user can implement a tool. The suspension mechanism 2 relates to a medium capable of adequately supporting and arranging the plurality of photothermal particles 3 throughout the tool body 1. The suspension mechanism 2 may take on any of a variety of physical and thermal properties including, but not limited to, variations in elasticity, hardness, toughness, malleability, shape, size, thermal conductivity, thermal shock resistance, and more, as required for a particular application. The plurality of photothermal particles 3 relates to a substance that responds to incident resonant radiation by generating heat and subsequently transferring that heat to the tool body 1. Furthermore, at least one portable electromagnetic (EM) wave generator 4 is provided, wherein the portable EM wave generator 4 either is integrated into the tool body 1, as represented in FIG. 2, or is positioned adjacent to the tool body 1, as represented in FIG. 3, wherein the portable EM wave generator 4 includes a manual on/off switch (Step B). The portable EM wave generator 4 relates to a device or set of devices capable of emitting targeted radiative waves of a predetermined wavelength onto the plurality of photothermal particles 3. The manual on/off switch allows a user to manually activate or manually deactivate the portable EM wave generator 4.

The overall process followed by the method of the present invention allows for controlled generation of heat within a variety of physical objects. An EM signal is emitted from the EM wave generator to the suspension mechanism 2, if the manual on/off switch is toggled to an on setting (Step C), as represented in FIG. 4. The EM signal relates to any EM wave pattern or combination emitted at a frequency capable of affecting the plurality of photothermal particles 3. Thus, user inputs determine the active or inactive status of the portable EM wave generator 4, and ultimately, the heat generated by the plurality of photothermal particles 3. The tool body 1 is subsequently heated as the EM signal interacts with the plurality of photothermal particles 3 (Step D). Heat from the plurality of photothermal particles 3 preferably radiates into the suspension mechanism 2 and is conductively transfers from the suspension mechanism 2 into the tool body 1. Finally, the EM wave generator is deactivated, if the manual on/off switch is toggled to an off setting (Step E). In this way, a user may control the amount of heat that the tool body 1 emits by moderating the manual on/off switch.

Figure 5:
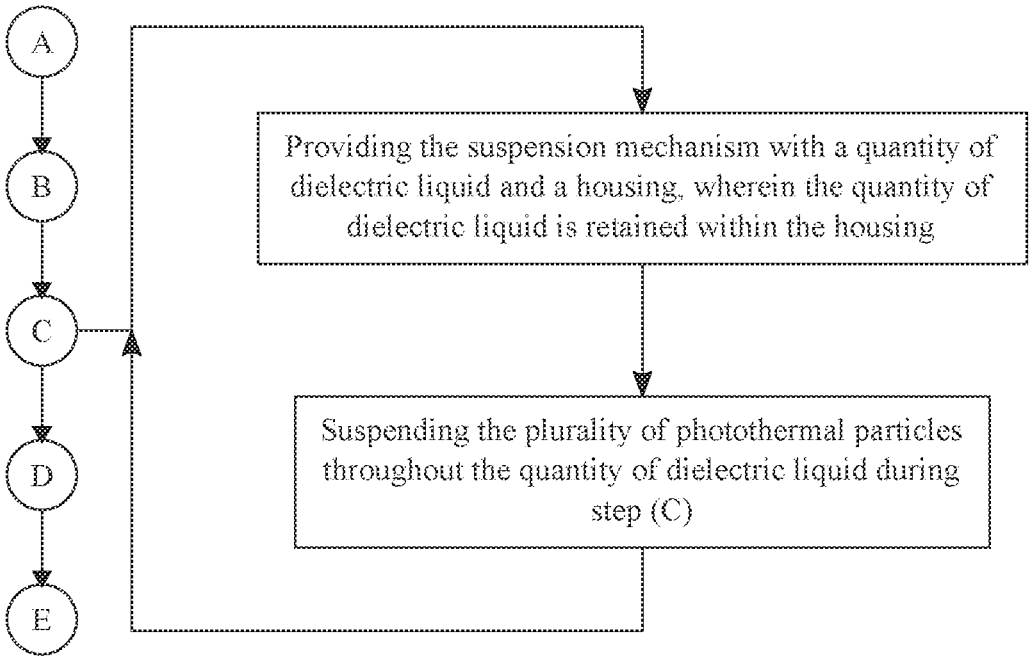
FIG. 5 is a flowchart illustrating the subprocess of suspending particles within a dielectric fluid.

The plurality of photothermal particles 3 may require preparation or arrangement in order to ultimately ensure the even distribution of heat throughout the tool body 1. To enable this, the suspension mechanism 2 is provided with a quantity of dielectric liquid and a housing, wherein the quantity of dielectric liquid is retained within the housing, as represented in FIG. 5. The quantity of dielectric liquid relates to any fluid substance capable of allowing permeation of the plurality of photothermal particles 3 throughout the housing. The housing relates to the physical structure defining the arrangement and dispersion of the fluid substance throughout the tool body 1. The plurality of photothermal particles 3 is suspended throughout the quantity of dielectric liquid during Step C. In this way, the plurality of photothermal particles 3 increases the temperature of the quantity of dielectric liquid and the housing and consequently increases the temperature of the tool body 1.

The quantity of dielectric liquid must have physical properties that enable, and preferably enhance, transmission of the heat generated by the plurality of photothermal particles 3. To this end, in an exemplary embodiment, the quantity of dielectric liquid is water. Water has high thermal resistivity and therefore retains transmitted heat more effectively than other fluids, which allows the water to act as a steady source of heat. However, it is to be understood that a variety of fluids, including salt water, various aqueous solutions, and more, are also capable of providing desirable particle dispersion and thermal properties, and the preferred embodiment of water is not meant to be limiting.

Figure 10:
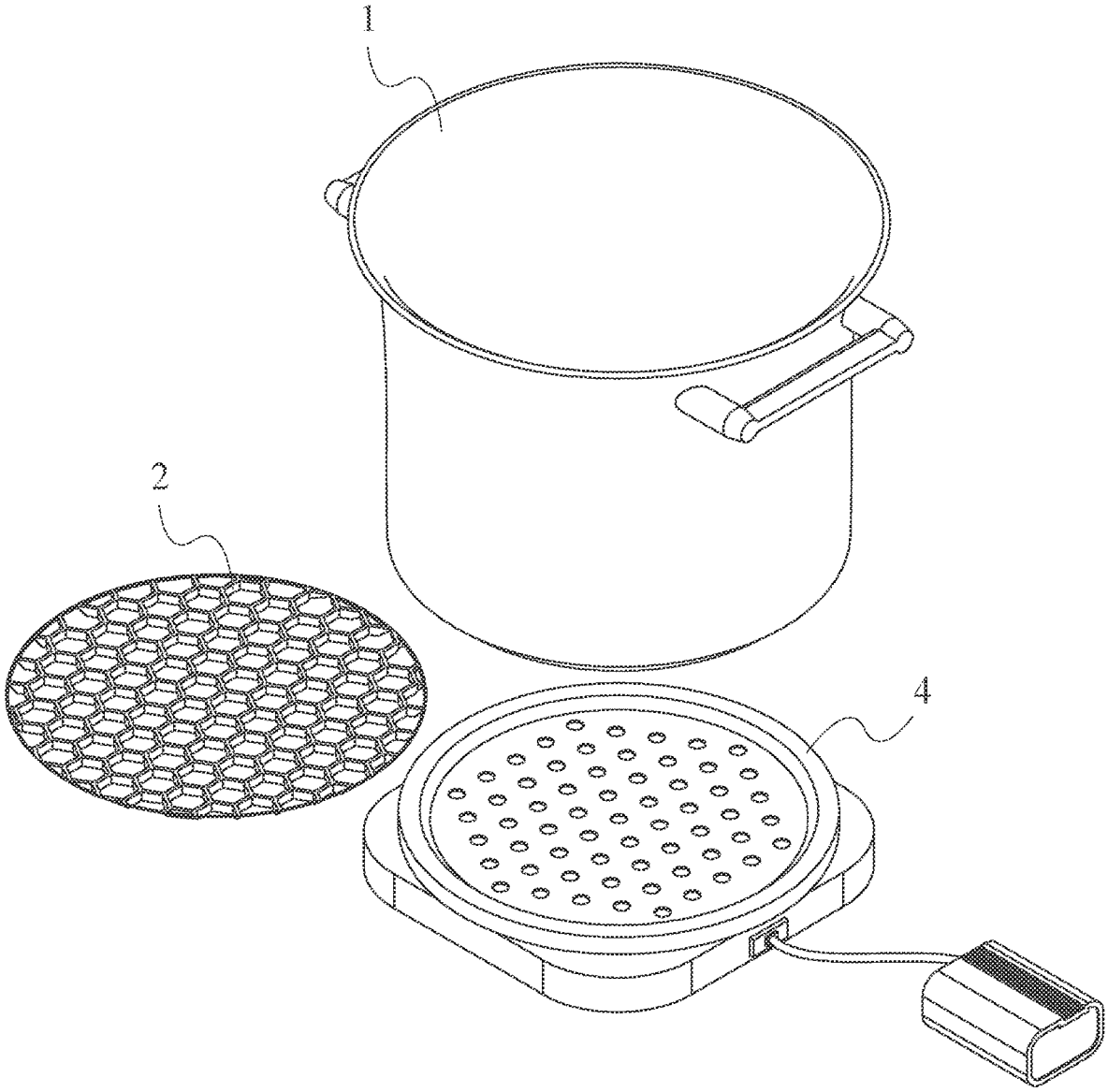
FIG. 10 is a perspective view illustrating a cookware heated by photothermal particles.
Figure 11:
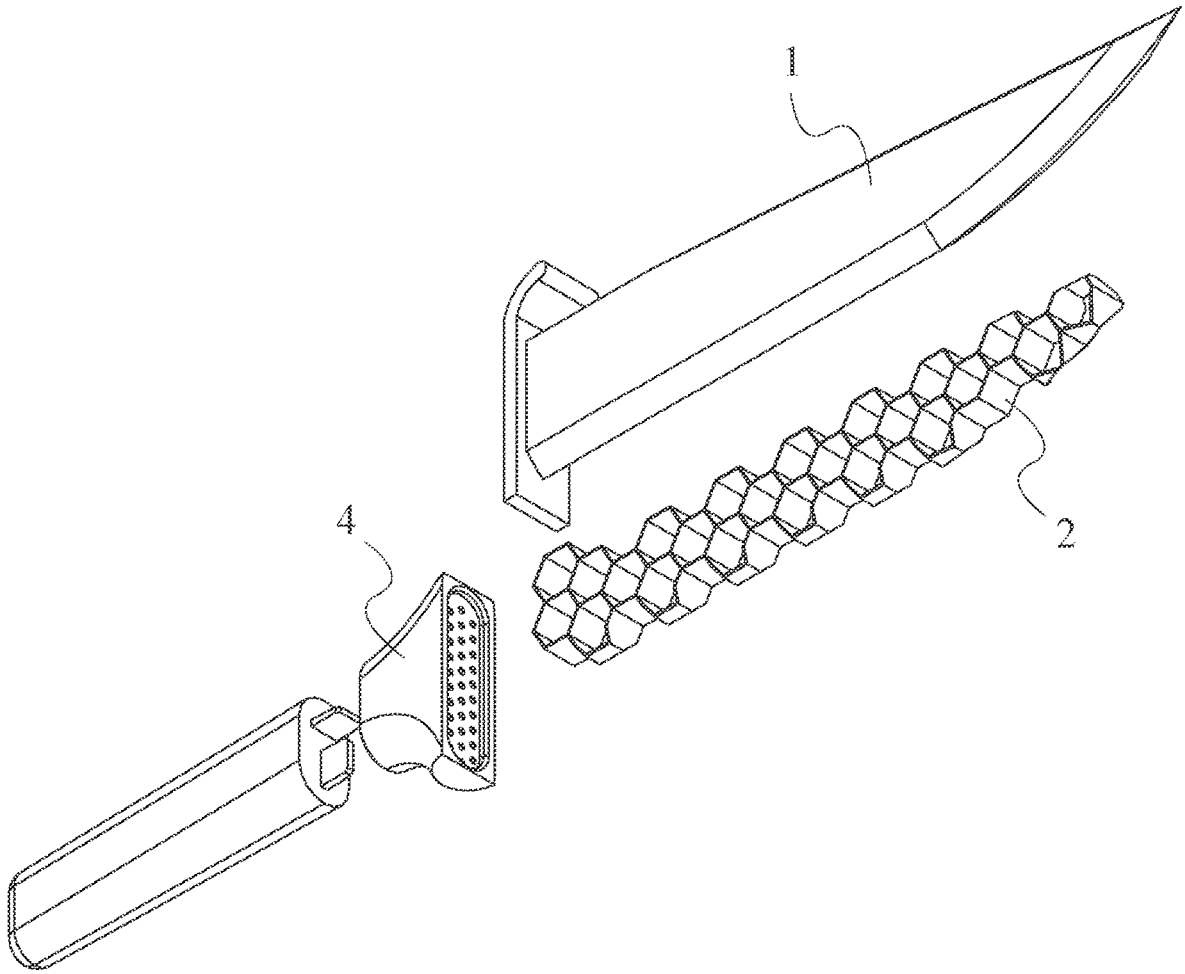
FIG. 11 is a perspective view illustrating a knife blade heated by photothermal particles.
Figure 12:
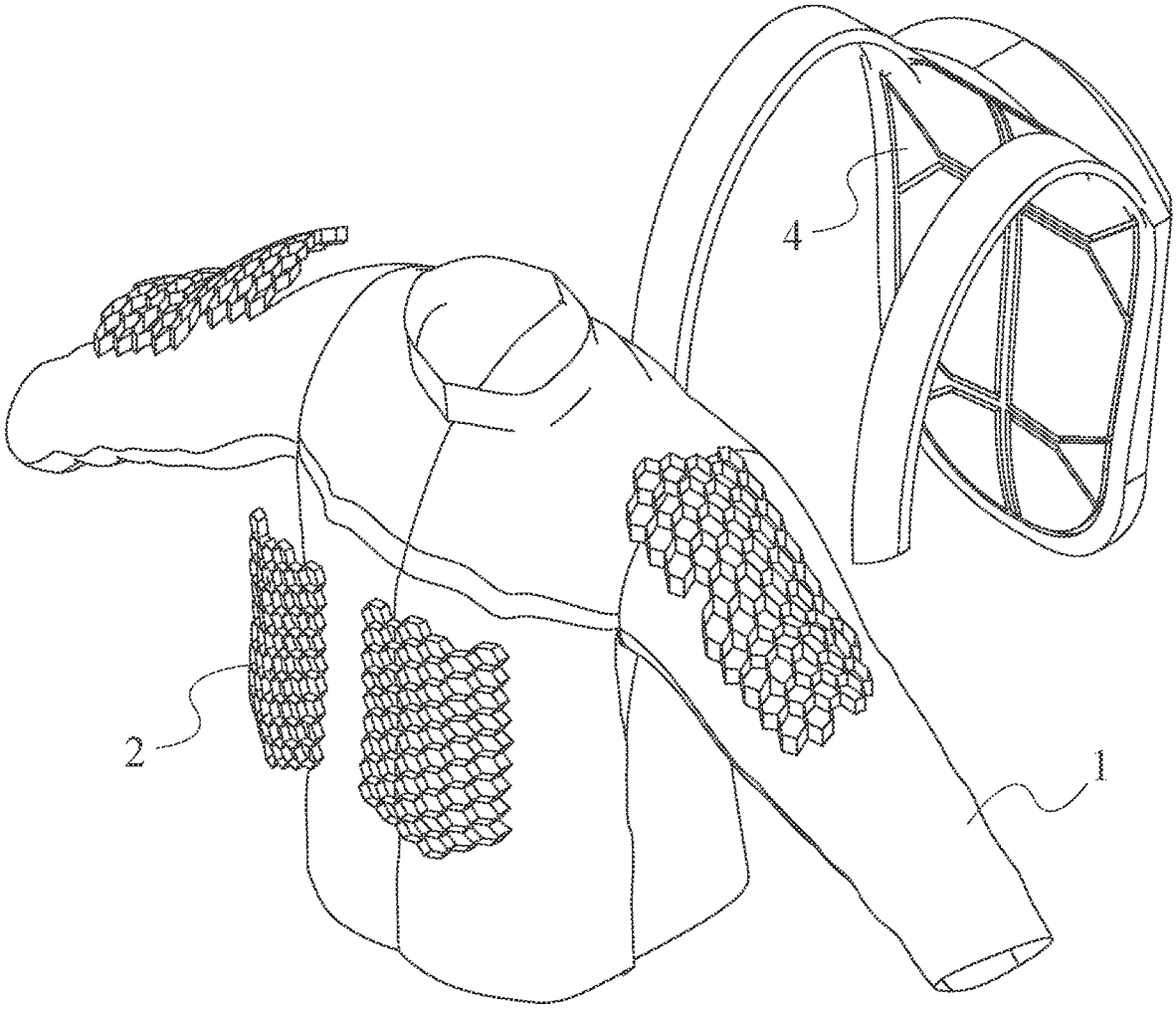
FIG. 12 is a perspective view illustrating an article of clothing heated by photothermal particles.

Heating through the tool body 1 is made most effective by optimally positioning and orienting the housing within the tool body 1. In order to facilitate the dispersion of heat, the housing is a hollow hexagonal mesh, as represented in FIG. 10-12. A hexagonal mesh ensures optimal distribution of the plurality of photothermal particles 3 throughout the tool body 1, without conceding or reducing necessary mechanical properties. While a hollow hexagonal mesh is preferred, it is to be understood that a variety of shapes and orientations of the tool body 1 may be preferred for specific applications, and the preferred embodiment is not meant to be limiting.

The plurality of photothermal particles 3 must be composed of microscopic or nanoscopic particles capable of appropriately converting EM wave energy into thermal energy. To provide this, in the preferred embodiment, the plurality of photothermal particles 3 is a quantity of gold nanoparticles. Gold nanoparticles have been found to exhibit a particularly strong correlation between wave incidence and heat generation at promising wave frequencies. It is to be understood that while a quantity of gold nanoparticles is preferred, other particles, such as iron oxide, a variety of coated, uncoated, or conjugated metal nanoparticles, or more, may also be utilized to achieve the desired physical response, and the preferred embodiment is not meant to be limiting.

In order to operate appropriately, the plurality of photothermal particles 3 must be activated by EM radiation at an appropriate frequency so as to enable resonance. To achieve this, the EM wave generator is configured to emit the EM signal as a radio wave. Radio wavelengths are not only relatively safer than wavelengths of higher frequencies but are also appropriate for interacting with the plurality of photothermal particles 3 in many embodiments. However, it is to be understood that a wide array of wavelengths may be utilized in order to induce resonant heat generation in the plurality of photothermal particles 3, and the preferred embodiment is not meant to be limiting.

Each EM wave generator requires a sufficient power supply in order to emit appropriate wavelengths towards the tool body 1. To this end, the EM wave generator is configured to be a solar-powered device, a battery-powered device, or a piezoelectrically-powered device. Such energy sources and supplies would adequately and efficiently address the energetic requirements of the EM wave generator. While the preferred embodiment of a solar-powered device, a battery-powered device, or a piezoelectrically-powered device is specified, it is to be understood that other electrical sources could be utilized to provide electrical power, including a combination or array of any of the aforementioned electrical sources, or more electrical sources, and the preferred embodiment is not meant to be limiting.

Figure 6:
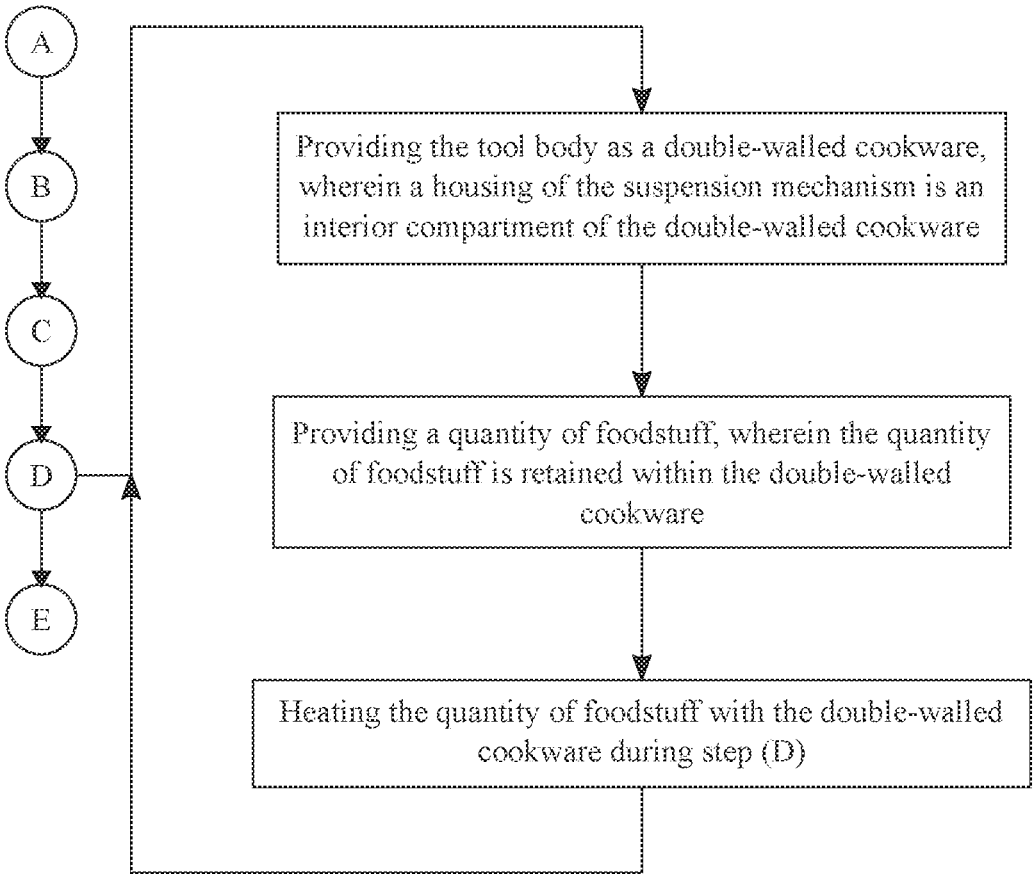
FIG. 6 is a flowchart illustrating the subprocess of heating foodstuff with photothermal particles.

The heating provided through EM wave stimulation of the plurality of photothermal particles 3 may be harnessed in a variety of useful applications, especially in cooking applications. To this end, the tool body 1 is provided as a double-walled cookware, wherein a housing of the suspension mechanism 2 is an interior compartment of the double-walled cookware, as represented in FIGS. 6 and 10. The double-walled cookware may relate to a variety of different pots, pans, skillets, or more cooking devices. A quantity of foodstuff is provided, wherein the quantity of foodstuff is retained within the double-wall cookware. This arrangement corresponds to a variety of common cooking techniques and may include mediums that will not explicitly be consumed, such as twine, other cookware, and more. The quantity of foodstuff is then heated with the double-walled cookware during Step D. In this way, the tool body 1 may be utilized as the primary heat source for a variety of cooking applications.

It may be further advantageous in particular use cases to provide a more portable mechanism for controlling the heat generated by the plurality of photothermal particles 3. Therefore, the at least one portable EM wave generator 4 may be a single generator, wherein the single generator is integrated into the double-walled cookware. This combination enhances overall portability in many cases by preventing the user from having to separately transport the tool body 1 and the portable EM wave generator 4.

Alternatively, it may be advantageous for cooking purposes to provide the plurality of photothermal particles 3 with energy supplied from around the tool body 1, thus further enhancing even heat distribution. To achieve this, the at least one portable EM wave generator 4 may be a plurality of generators, wherein the plurality of generators is radially positioned around the double-walled cookware. This arrangement supplements the ability of the housing to disperse a more powerful heat across the tool body 1, thus enabling more even cooking and alternative cooking capabilities.

Figure 7:
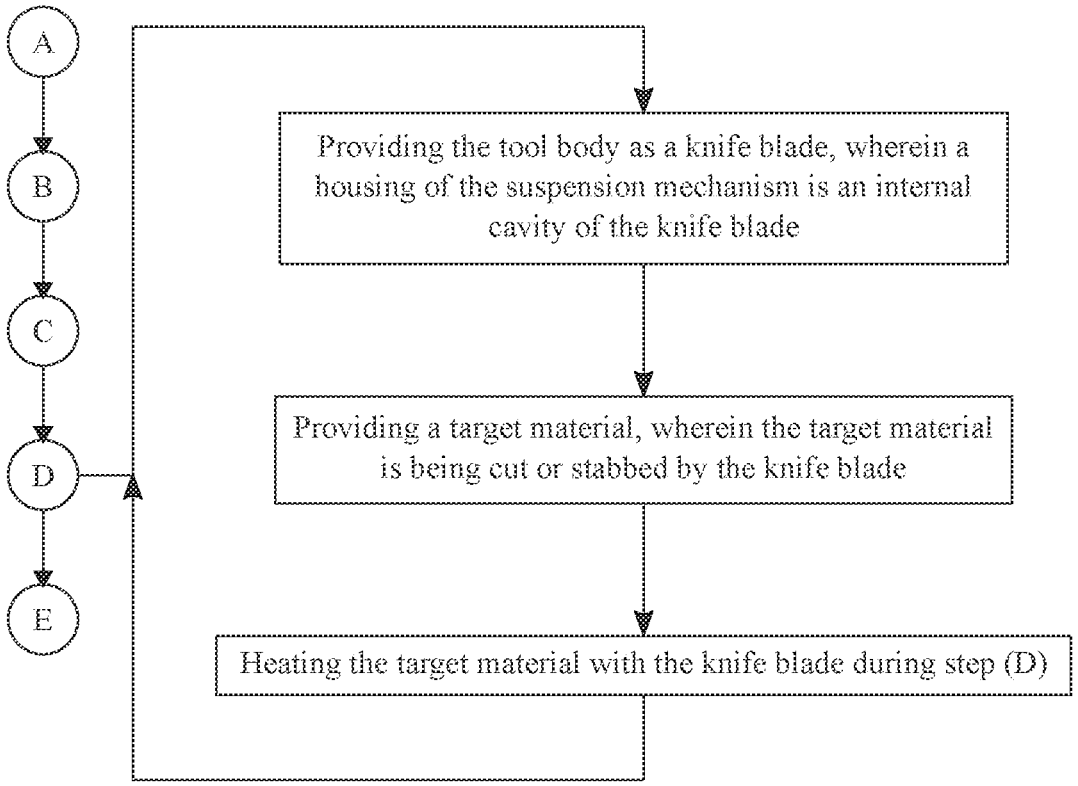
FIG. 7 is a flowchart illustrating the subprocess of heating a knife blade with photothermal particles.

Another desirable application for heating is in the body of cutting equipment. To this end, the tool body 1 is provided as a knife blade, wherein a housing of the suspension mechanism 2 is an internal cavity of the knife blade, as represented in FIGS. 7 and 11. The arrangement of the suspension mechanism 2 within the knife blade preferably allows for equally distributed heat throughout the knife blade. A target material is provided, wherein the target material is being cut or stabbed by the knife blade. The target material may be any type of foodstuffs, rope, building materials, or a variety of other items which can be cut more easily with a heated blade. The target material is heated with the knife blade during Step D. This heating may take place during the cut or before the cut in order to improve material malleability before cutting.

Figure 8:
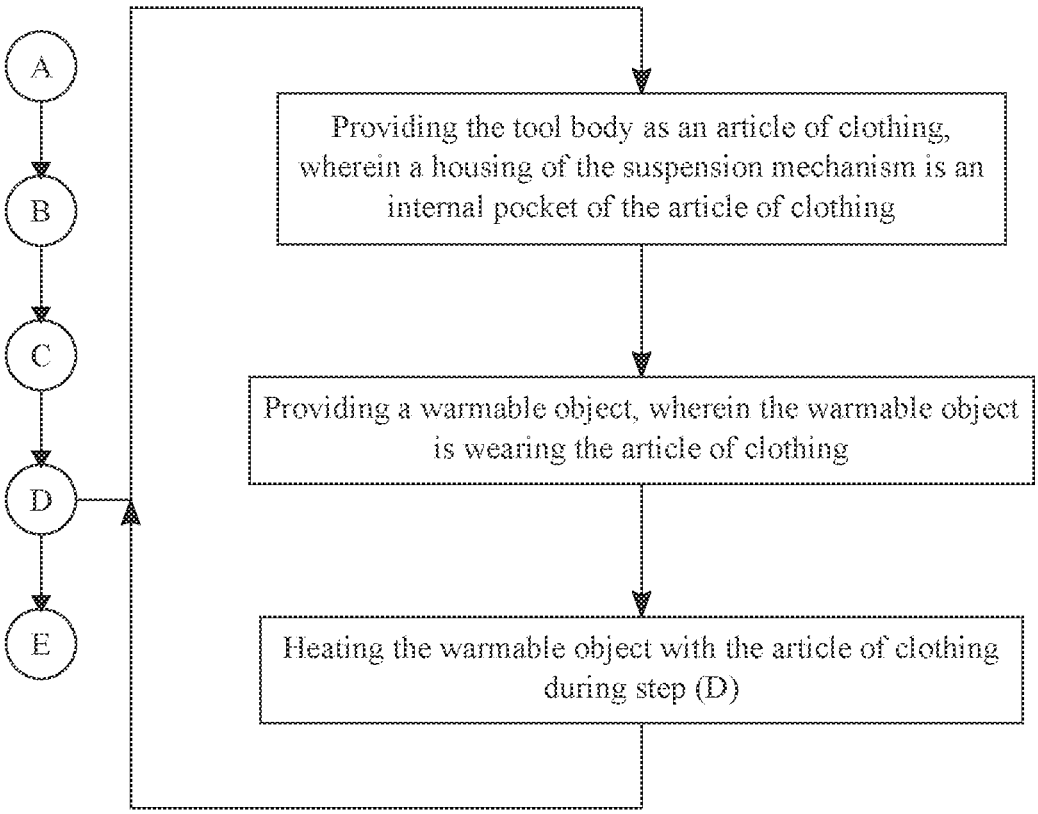
FIG. 8 is a flowchart illustrating the subprocess of heating an article of clothing with photothermal particles.

Another desirable target for the application of heat is in a wide array of clothing, apparel, fabrics, and textile products. To this end, the tool body 1 is provided as an article of clothing, wherein a housing of the suspension mechanism 2 is an internal pocket of the article of clothing, as represented in FIGS. 8 and 12. The internal pocket may relate to a single patch or area of the article of clothing or may relate to a unit that encompasses the volume of the article of clothing that is stitched, hemmed, sewn, layered, or otherwise arranged generally within the article of clothing. Furthermore, a warmable object is provided, wherein the warmable object is wearing the article of clothing. The warmable object is preferably a human being but may also include a variety of other items that require external heat. The warmable object is heated with the article of clothing during Step D. In this way, the warmable object receives the heat necessary to perform or operate.

Figure 9:
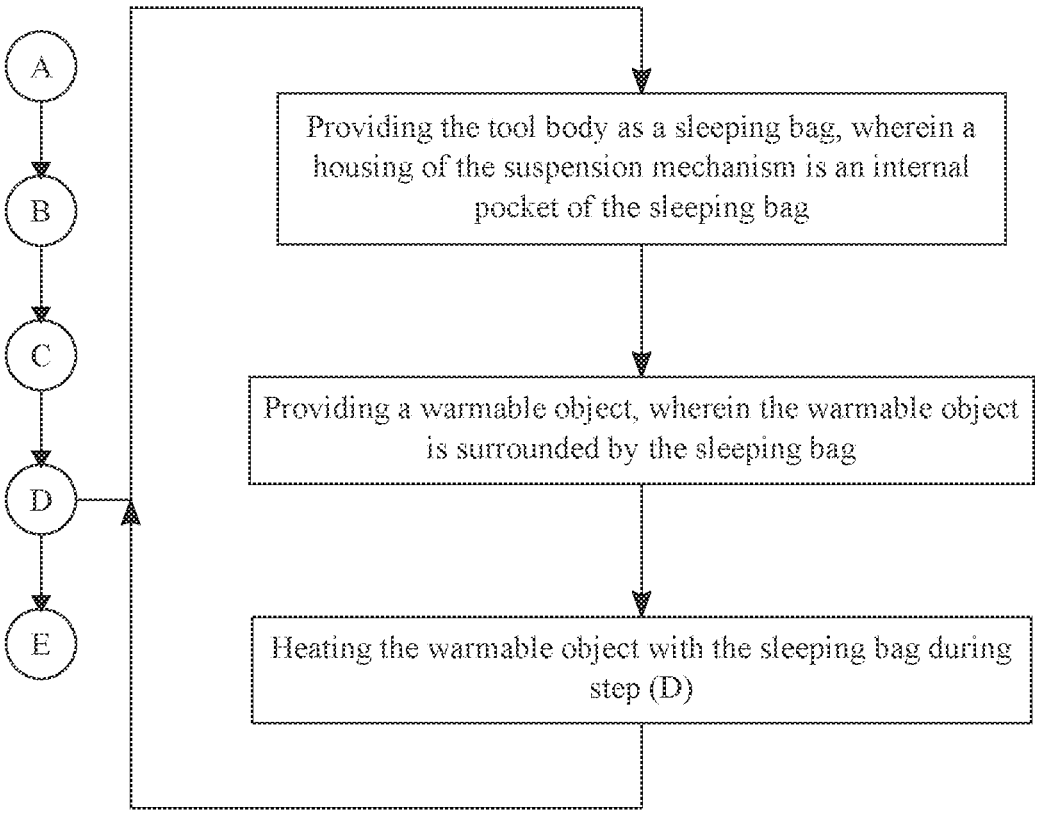
FIG. 9 is a flowchart illustrating the subprocess of heating a sleeping bag with photothermal particles.

Further, sleeping tools, especially those intended for outdoor use, may benefit from the employment of convenient external heating. To this end, the tool body 1 is provided as a sleeping bag, wherein a housing of the suspension mechanism 2 is an internal pocket of the sleeping bag, as represented in FIG. 9. The sleeping bag may include any apparatus generally utilized as an overnight enclosure for human comfort in outdoor environments. The internal pocket may relate to a single patch or area of the sleeping bag or may relate to a unit that encompasses the volume of the sleeping bag that is stitched, hemmed, sewn, layered, or otherwise arranged generally within the sleeping bag. A warmable object is also provided, wherein the warmable object is surrounded by the sleeping bag. The warmable object is preferably a human being but may also include a variety of other items that require external heat. The warmable object is heated with the sleeping bag during Step D. This arrangement ensures that the warmable object receives heat required for optimal function.

Although the invention has been explained in relation to its preferred embodiment, it is to be understood that many other possible modifications and variations can be made without departing from the spirit and scope of the invention as hereinafter claimed.

What is claimed is:

1. A method of heating a tool with electromagnetic radiation, the method comprises the steps of:

(A) providing at least one tool body, at least one suspension mechanism, and a plurality of photothermal particles, wherein the suspension mechanism is integrated into the tool body, and wherein the plurality of photothermal particles is distributed throughout the suspension mechanism, and wherein the suspension mechanism comprises a quantity of dielectric liquid and a housing, and wherein the quantity of dielectric liquid is retained within the housing;

(B) providing at least one portable electromagnetic (EM) wave generator, wherein the portable EM wave generator either is integrated into the tool body or is positioned adjacent to the tool body, wherein the portable EM wave generator includes a manual on/off switch;

(C) emitting an EM signal from the EM wave generator to the suspension mechanism, if the manual on/off switch is toggled to an on setting;

(D) heating the tool body as the EM signal interacts with the plurality of photothermal particles;

(E) deactivating the EM wave generator, if the manual on/off switch is toggled to an off setting; and suspending the plurality of photothermal particles throughout the quantity of dielectric liquid during step (C).

2. The method of heating a tool with electromagnetic radiation, the method as claimed in claim 1, wherein the quantity of dielectric liquid is water.

3. The method of heating a tool with electromagnetic radiation, the method as claimed in claim 1, wherein the housing is a hollow hexagonal mesh.

4. The method of heating a tool with electromagnetic radiation, the method as claimed in claim 1, wherein the plurality of photothermal particles is a quantity of gold nanoparticles.

5. The method of heating a tool with electromagnetic radiation, the method as claimed in claim 1, wherein the EM wave generator is configured to emit the EM signal as a radio wave.

6. The method of heating a tool with electromagnetic radiation, the method as claimed in claim 1, wherein the EM wave generator is configured to be a solar-powered device, a battery-powered device, or a piezoelectrically-powered device.

7. The method of heating a tool with electromagnetic radiation, the method as claimed in claim 1 comprises the steps of:

providing the tool body as a double-walled cookware, wherein the housing of the suspension mechanism is an interior compartment of the double-walled cookware;

providing a quantity of foodstuff, wherein the quantity of foodstuff is retained within the double-walled cookware; and heating the quantity of foodstuff with the double-walled cookware during step (D).

8. The method of heating a tool with electromagnetic radiation, the method as claimed in claim 7, wherein the at least one portable EM wave generator is a single generator, and wherein the single generator is integrated into the double-walled cookware.

9. The method of heating a tool with electromagnetic radiation, the method as claimed in claim 7, wherein the at least one portable EM wave generator is a plurality of generators, and wherein the plurality of generators is radially positioned around the double-walled cookware.

10. The method of heating a tool with electromagnetic radiation, the method as claimed in claim 1 comprises the steps of:

providing the tool body as a knife blade, wherein the housing of the suspension mechanism is an internal cavity of the knife blade;

providing a target material, wherein the target material is being cut or stabbed by the knife blade; and heating the target material with the knife blade during step (D).

11. The method of heating a tool with electromagnetic radiation, the method as claimed in claim 1 comprises the steps of:

providing the tool body as an article of clothing, wherein the housing of the suspension mechanism is an internal pocket of the article of clothing;

providing a warmable object, wherein the warmable object is wearing the article of clothing; and heating the warmable object with the article of clothing during step (D).

12. The method of heating a tool with electromagnetic radiation, the method as claimed in claim 1 comprises the steps of:

providing the tool body as a sleeping bag, wherein the housing of the suspension mechanism is an internal pocket of the sleeping bag;

providing a warmable object, wherein the warmable object is surrounded by the sleeping bag; and heating the warmable object with the sleeping bag during step (D).

* * * * *